US009168537B2

(12) United States Patent
Fu

(10) Patent No.: US 9,168,537 B2
(45) Date of Patent: Oct. 27, 2015

(54) MAGNETIC RACK

(71) Applicant: Nvigen, Inc., Sunnyvale, CA (US)

(72) Inventor: Aihua Fu, Santa Clara, CA (US)

(73) Assignee: NVIGEN, INC., Sunnyvale, CA (US)

( * ) Notice: Subject to any disclaimer, the term of this patent is extended or adjusted under 35 U.S.C. 154(b) by 0 days.

(21) Appl. No.: 14/244,907

(22) Filed: Apr. 4, 2014

(65) Prior Publication Data

US 2014/0305849 A1 Oct. 16, 2014

Related U.S. Application Data

(60) Provisional application No. 61/810,279, filed on Apr. 10, 2013.

(51) Int. Cl.

| | |
|---|---|
| ***B03C 1/00*** | (2006.01) |
| ***B01L 9/06*** | (2006.01) |
| ***B03C 1/28*** | (2006.01) |

(52) U.S. Cl.

CPC ... *B03C 1/00* (2013.01); *B01L 9/06* (2013.01); *B03C 1/288* (2013.01); *B01L 2200/0668* (2013.01); *B01L 2400/043* (2013.01); *B03C 2201/20* (2013.01); *B03C 2201/26* (2013.01)

(58) Field of Classification Search

CPC ..... B03C 2201/18; B03C 2201/20; B03C 2201/26; B03C 2201/28; B01L 9/06

See application file for complete search history.

(56) References Cited

U.S. PATENT DOCUMENTS

| | | | | |
|---|---|---|---|---|
| 6,193,892 | B1 * | 2/2001 | Krueger et al. | 210/695 |
| 8,574,515 | B2 * | 11/2013 | Ellis et al. | 422/527 |
| 2011/0198293 | A1 * | 8/2011 | Ellis et al. | 210/695 |

* cited by examiner

*Primary Examiner* — Michael McCullough

(74) *Attorney, Agent, or Firm* — Jun He Law Offices P.C.; James J. Zhu

(57) ABSTRACT

The present application provides a magnetic rack for separating magnetic particles from a non-magnetic medium. The magnetic rack comprises a supporting housing having a top side, a bottom side, two opposite lengthwise sides, and a cavity, wherein at least one magnet is disposed in the cavity, each lengthwise side is attached with a receiving member, and the top side has at least two sockets. The magnetic rack further comprises a pair of supporting walls, wherein each supporting wall has a fixing member introduced onto or into the receiving member to tightly connect the supporting housing with the pair of supporting walls. With the coupling of the receiving member and the fixing member, the supporting wall and the supporting housing can be tightly connected together, therefore the shake of the magnetic rack or the sample vials inserted in the magnetic rack can be significantly avoided. In this way, the magnetic particles can be effectively separated from a non-magnetic medium in the sample vial.

11 Claims, 5 Drawing Sheets

MAGNETIC RACK

TECHNICAL FIELD

The present application relates to a magnetic rack for separating magnetic particles from a non-magnetic medium.

BACKGROUND

Magnetic field can be used to separate magnetic particles from a non-magnetic medium such as a suspension, which has a wide application in chemistry, biochemistry or medical sciences. Specifically, a rack-like arrangement is convenient for simultaneously processing a number of samples contained in respective sample vials. Therefore, various magnetic racks with magnets disposed therein have been developed. The magnets may be positioned in a row along a lengthwise direction of the magnetic rack to provide the magnetic field. When a sample vial is inserted into the magnetic rack and approaches the magnets, the magnetic field can affect the suspended magnetic particles that are dispersed within the suspension in the sample vial, and pull down the particles using magnetic forces. The particles will then be collected and concentrated along the side wall of the sample vial. Since the magnets are needed to be placed into the inside of the magnetic rack, the magnetic rack is generally designed to include several physical parts that can be assembled by means of mechanical connections. In general, the physical parts of magnetic racks can not be irreversibly fixed, since there is a need to be able to remove the sample rack part and process the samples for example by shaking or heating. In addition, the magnetic rack must be able to tightly hold together when assembled for magnetic separation of samples, otherwise, the magnetic particle pellet that is pulled down by magnetic forces could be disturbed, especially when the particle size is small, so that either partial sample will be lost or the supernatant will not be completely removed.

Therefore, there is a continued need to innovate a magnetic rack design so that it will work ideally for magnetic separation applications.

SUMMARY OF THE INVENTION

An objective of the present application is to provide a magnetic rack, the mechanical structure of which could be firmly assembled together when for magnetic separation use, while the sample rack part could be conveniently removed for non-magnetic processing.

In an aspect, the present application provides a magnetic rack. The magnetic rack comprises a supporting housing having a top side, a bottom side, two opposite lengthwise sides, and a cavity, wherein at least one magnet is disposed in the cavity, each lengthwise side is attached with a receiving member, and the top side has at least two sockets. The magnetic rack further comprises a pair of supporting walls, wherein each supporting wall has a fixing member introduced onto or into the receiving member to tightly connect the supporting housing with the pair of supporting walls.

With the coupling of the receiving member and the fixing member, the supporting wall and the supporting housing can be tightly connected together, therefore the shake of the magnetic rack or the sample vials inserted in the magnetic rack can be significantly avoided. In this way, the magnetic particles can be effectively separated from a non-magnetic medium in the sample vial, such that the magnetic particles and associated bio-molecules can be attracted into a tight magnetic pellet onto the side wall or bottom of the sample vial.

In certain embodiments, the magnetic rack further comprises a retaining plate having a downward side, an upward side, at least one aperture for holding a sample vial, and at least two supporting members protruding from the downward side, wherein the supporting members are slidable into the sockets so that the retaining plate is removably supported on the top side of the supporting housing. The coupling of the sockets and the supporting member helps to secure the retaining plate with the supporting housing, thereby avoiding shake of the sample vial in the retaining plate. Furthermore, the retaining plate could be conveniently removed from the supporting housing for non-magnetic processing.

In certain embodiments, the magnetic rack further comprises a substrate plate attachable to the bottom side of the supporting housing and/or the pair of supporting walls. The substrate plate helps the magnetic rack to stand stably on a supporting surface, such as an operation desk or a test table.

In certain embodiments, the substrate plate has a ridge protruding towards the cavity and including at least one recess for accommodating the at least one magnet.

In certain embodiments, the magnetic rack further comprises a pair of supporting wall covers disposed on the retaining plate, and configured to clamp the retaining plate with the pair of supporting walls therebetween. The pair of supporting wall covers helps to avoid shake or movement of the retaining plate.

In certain embodiments, the receiving member comprises a side socket extending between the top side and the bottom side, and the fixing member comprises a side plug parallel with the side socket and insertable into the side socket.

In certain embodiments, each supporting wall has a groove at least partially extending between its top side and bottom side, and the lengthwise sides of the supporting housing are embedded into the respective grooves of the pair of supporting walls. The coupling of the groove with the supporting wall can enhance the stability of the magnetic rack, and prevent the supporting walls from displacing along a widthwise direction of the supporting housing.

In certain embodiments, the at least one magnet is such configured that magnetic pellets in a sample vial retained in the magnetic rack are pulled down to the sidewall of the sample vial but above the bottom of the sample vial. In this way, the magnetic rack may collect the magnetic pellets to the side wall of the sample vial, and leave the bottom of the vial free of magnetic pellets. Thus, it is convenient to completely remove the supernatant in the sample vial by using a pipette or other utensils since its tip could touch the bottom of the sample vial to suck out more completely the solutions.

In certain embodiments, the magnetic pellets pulled down by the magnetic force are of a dimension smaller than 12 mm.

In certain embodiments, the magnetic rack further comprises: a stand attached onto the retaining plate and configured to support the retaining plate on a supporting surface when the retaining plate is removed from the supporting house.

In certain embodiments, the stand comprises multiple pillars secured on the downward side of the retaining plate and with a length greater than that of the supporting members.

In certain embodiments, the multiple pillars are positioned at four corners of the retaining plate.

In certain embodiments, the stand is integrally formed with the retaining plate.

The foregoing has outlined, rather broadly, features of the present application. Additional features of the present application will be described, hereinafter, which form the subject of the claims of the present application. It should be appreciated by those skilled in the art that the conception and specific embodiments disclosed herein may be readily utilized as a basis for modifying or designing other structures or processes for carrying out the objectives of the present application. It should also be realized by those skilled in the art that such equivalent constructions do not depart from the spirit and scope of the present application as set forth in the appended claims.

BRIEF DESCRIPTION OF THE DRAWINGS

The aforementioned features and other features of the application will be further described in the following paragraphs by referring to the accompanying drawings and the appended claims. It will be understood that, these accompanying drawing merely illustrate some embodiments in accordance with the present application and should not be considered as limitation to the scope of the present application. Unless otherwise specified, the accompanying drawings need not be proportional, and similar reference characters generally denote similar elements.

DETAILED DESCRIPTION OF ILLUSTRATIVE EMBODIMENTS

The following detailed description refers to the accompanying drawings as a part of the present disclosure. The illustrative embodiments described in the detailed description, the accompanying drawings and the claims are not limiting, and other embodiments may be adopted, or modifications may be made without deviating from the spirit and subject of the disclosure. It should be understood that, the various aspects of the disclosure described and graphically presented herein may be arranged, replaced, combined, divided and designed in many different configurations, and these different configurations are implicitly included in the disclosure.

In the following paragraphs, some specific terms will be used to clearly describe the illustrative embodiments. However, the intent of using these terms is not to limit the scope of protection of this disclosure, the scope of these terms should extend to any equivalent replacements that achieve substantially the same objective in substantially the same way.

Figure 1:
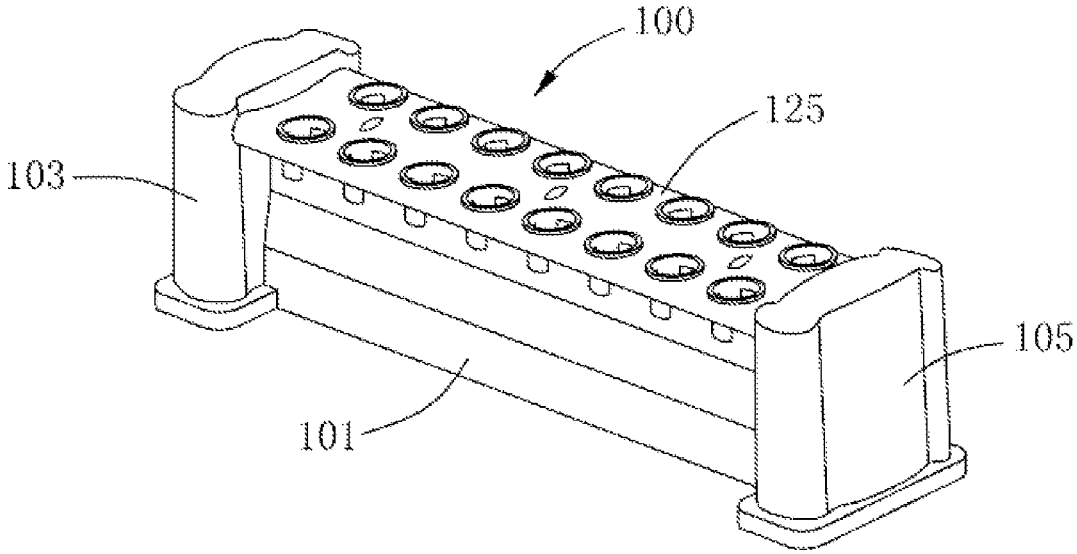
FIGS. 1-5 show a perspective view, a plan view, a side view and explosive views of a magnetic rack 100 according to an embodiment of the present application, respectively.
Figure 2:
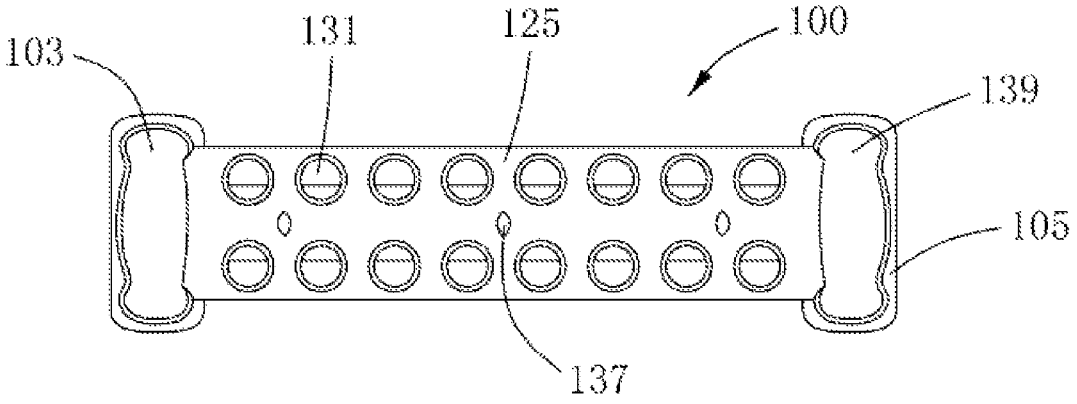
Figure 3:
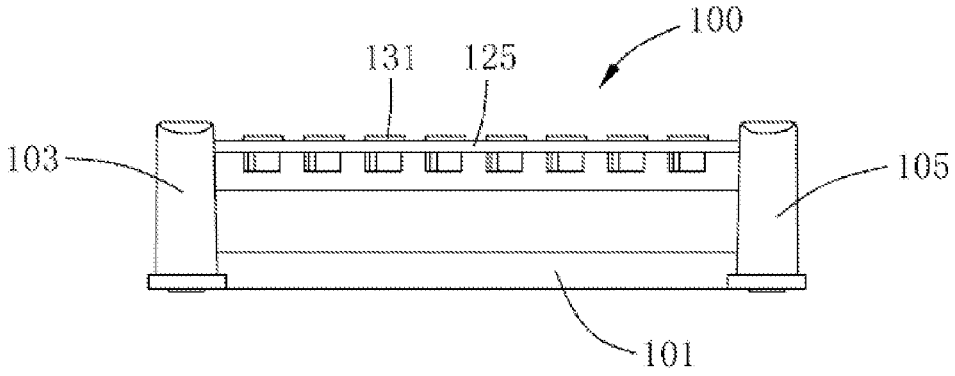
Figure 4:
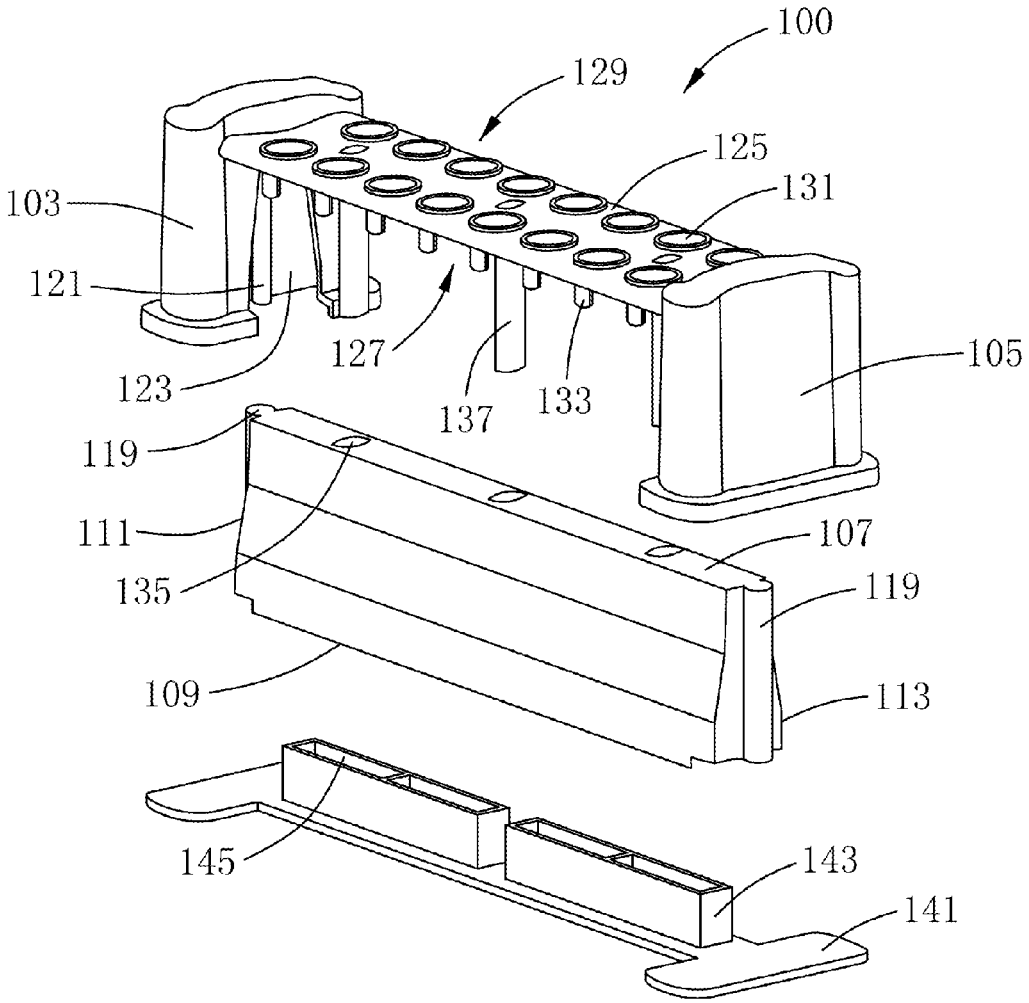
Figure 5:
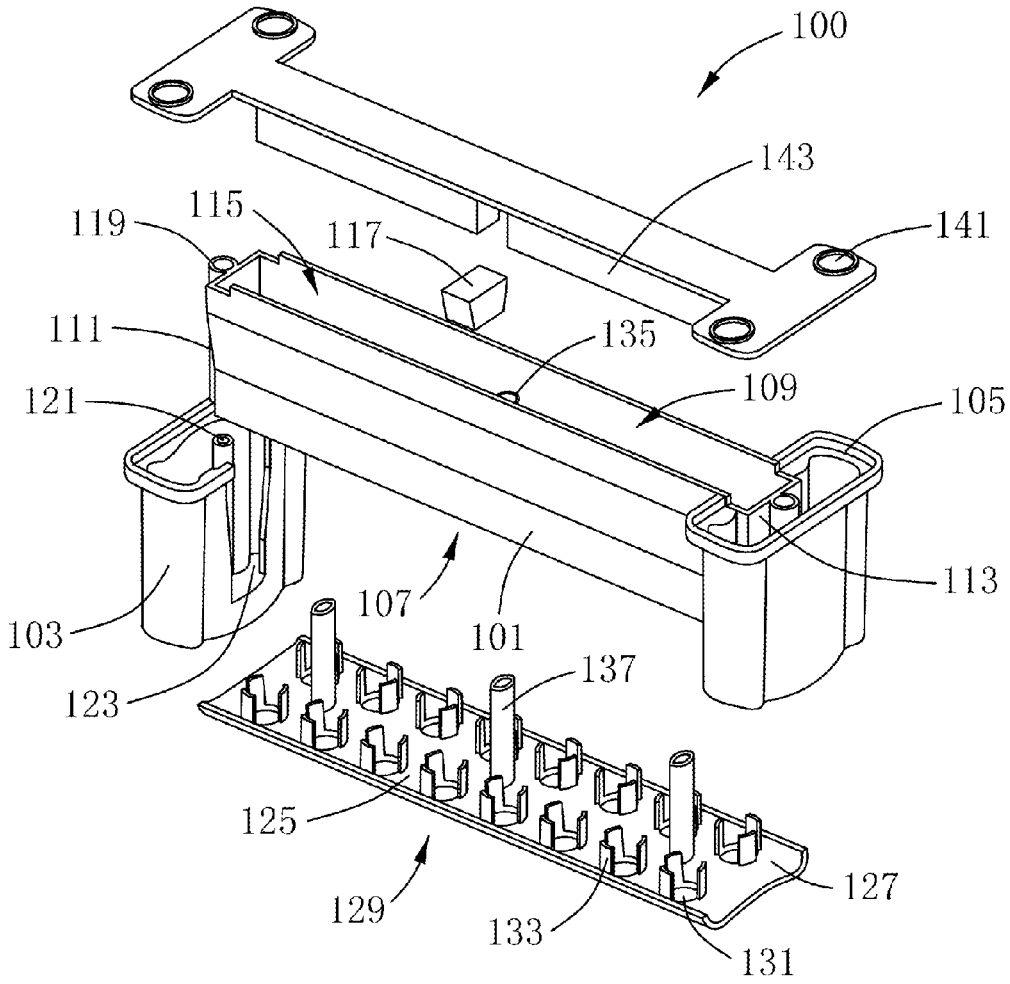

FIGS. 1-5 show a perspective view, a plan view, a side view and explosive views of a magnetic rack 100 according to an embodiment of the present application, respectively. FIG. 5 shows the magnetic rack 100 in a reverse direction of the views shown in FIGS. 1-4.

As shown in FIGS. 1-5, the magnetic rack 100 includes a supporting housing 101, and a pair of supporting walls 103 and 105. The supporting housing 101 has a top side 107, a bottom side 109 and two opposite lengthwise sides 111 and 113. In the embodiment, the supporting housing 101 is shaped as an elongated plate with a cavity 115, and the two lengthwise sides 111 and 113 are at two ends along the elongated direction, i.e. the longwise direction, of the supporting housing 101. The bottom side 109 of the supporting housing 101 is supported directly or indirectly on a supporting surface such as an operation desk or a test table. The cavity 115 is exposed from the bottom side 109 through an opening. At least one magnet 117 is disposed in the cavity 115 through the opening on the bottom side 109 to provide a magnetic field. In certain embodiments, the magnetic rack 100 may include two or more magnets 117 uniformly spaced apart along the lengthwise direction of the supporting housing 101.

The supporting walls 103 and 105 are connected on the lengthwise sides 111 and 113 of the supporting housing 101, respectively. In particular, each lengthwise side 111 or 113 of the supporting housing 101 is attached with a receiving member 119, such as a side socket, and each supporting wall 103 or 105 has a fixing member 121 matably coupled to the receiving member 119. The fixing member 121 is suitable to be introduced into or onto the receiving member 119 to tightly connect the supporting housing 101 with the pair of supporting walls 103 and 105. For example, the fixing member 121 may be a side plug having an outer wall that is substantial identical to an inner wall of the side socket (e.g., the side plug has an outer diameter identical to an inner diameter of the side socket). Then the fixing member 121 can be firmly inserted into the receiving member 119. Apparently, in certain embodiments, the fixing member 121 may be a side socket and the receiving member 119 may be a side plug parallel with the side pocket and insertable into the side pocket. In certain embodiments, the receiving member 119 and the fixing member 121 both extend between the top side 107 and the bottom side 109 of the supporting housing 101. When the fixing member 121 is introduced onto or into the receiving member 119, their coupling can prevent the supporting wall 103 or 105 from displacing along the lengthwise direction of the supporting housing 101.

Each supporting wall 103 or 105 has a groove 123 at least partially extending between its top side and bottom side, and the lengthwise sides 111 and 113 of the supporting housing 101 are embedded into the respective grooves 123 of the supporting walls 103 and 105. For example, the groove 123 may have an opening of a width identical to the width of the lengthwise side 111 or 113 of the supporting housing 101. The fixing member 121 may be disposed inside the groove 123. When the supporting housing 101 is connected to the supporting wall 103 or 105, the coupling of the groove 123 and the lengthwise side 111 or 113 can prevent the supporting wall 103 or 105 from displacing along the widthwise direction (i.e. a direction substantially perpendicular to the lengthwise direction) of the supporting housing 101. Therefore, the connection between the supporting housing 101 and the supporting wall 103 or 105 is much more stable.

In certain embodiments, the magnetic rack 101 has a retaining plate 125 disposed on the top side 107 of the supporting housing 101 and/or the supporting walls 103 and 105. The retaining plate 125 has a downward side 127 facing the supporting housing 101 and an upward side 129 opposite to the downward side 127. The retaining plate 125 has at least one aperture 131 for holding a sample vial (not shown). In certain embodiments, the retaining plate 125 has two rows of apertures 131 separately disposed on two lateral sides of the supporting housing 101, as shown in FIGS. 1-4. In particular, the apertures 131 have a diameter substantially the same as the diameter of the sample vial to be inserted in. Several clamp clips 133 are disposed around the apertures 131 and protrude downward (in the direction of FIGS. 1-3) from the downward side 127. The clamp clips 133 form a diameter smaller than the aperture's diameter, therefore the sample vial can be firmly clamped in the aperture 131 to avoid unnecessary shake. Those skilled in the art would readily appreciate that the arrangement of the retaining plate 125 shown in FIGS. 1-5 is merely exemplary and should not be construed as limiting the scope of the present application.

As shown in FIGS. 4 and 5, at least two sockets 135 are disposed on the top side 107 of the supporting housing 101. The sockets 135 extend downward (in the direction of FIGS. 1-3) from the topside 107 to the center or the bottom side 109 of the supporting housing 101. Further, the retaining plate 125 has at least two supporting members 137, such as plugs, protruding downward from the downward side 127. The supporting members 137 can slide into the respective sockets 135 when the retaining plate 125 is connected to the supporting housing 101. Therefore, the retaining plate 125 can be stably supported on the supporting housing 101 to position the sample vial under the magnetic field when for magnetic separation use. The magnetic particles and associated bio-molecules can be attracted into a tight magnetic pellet onto the side wall or bottom of the sample vial. In certain embodiments, the magnet 117 is such configured that the magnetic pellets in the sample vial retained in the magnetic rack 100, i.e. retained in the retaining plate 125, are pulled down to the sidewall of the sample vial but above the bottom of the sample vial. For example, the magnet 117 is positioned in a position of the supporting housing 101 close to the side wall of the sample vial when retained in the retaining plate 125. In this way, the magnetic rack 100 may collect the magnetic pellets to the side wall of the sample vial, and leave the bottom of the sample vial free of magnetic pellets. Thus, it is convenient to completely remove the supernatant in the sample vial by using a pipette or other utensils since its tip could touch the bottom of the sample vial to suck out more completely the solutions. In certain embodiments, the magnetic pellets pulled down by the magnetic force are of a dimension smaller than 12 mm.

Moreover, the retaining plate 125 can be removed from the top side 107 of the supporting housing 101 if needed. For example, the retaining plate 125 can be removed to carry the sample vials off the magnetic rack 100 for non-magnetic processing such as shaking or heating. In certain embodiments, the supporting housing 101 has three sockets 135, including one socket 135 disposed in the middle of the length of the supporting housing 101, and the other two sockets 135 disposed near the respective lengthwise sides of the supporting housing 101. Correspondingly, the retaining plate 125 has three supporting members 137 matably inserted into the sockets, respectively.

In certain embodiments, the magnetic rack 100 has a pair of supporting wall covers 139 disposed on the retaining plate 125. The supporting wall covers 139 can be used to clamp the retaining plate 125 with the pair of supporting walls 103 and 105 therebetween. The pair of supporting wall covers 139 enhance the stability of the magnetic rack 100 and prevent the retaining plate 125 from shaking when the sample vials are pull out.

In certain embodiments, the magnetic rack 100 has a substrate plate 141 attachable to the bottom side 109 of the supporting housing 101 and/or the supporting walls 103 and 105. The substrate plate 141 helps the magnetic rack 100 to stand stably on a supporting surface, such as an operation desk or a test table. Furthermore, the substrate plate 141 can enclose the opening on the bottom side 109 of the supporting housing 101 and seal the magnets 117 in the cavity 115. In certain embodiments, the substrate plate 141 has a ridge 143 protruding towards the cavity 115. The ridge 143 may include at least one recess 145 for accommodating the magnet 117. The recess 145 can fix the magnet 117 at a required position, thereby ensuring a stable magnetic field in the magnetic rack 100 for attracting the magnetic particles in the sample vial. As shown in FIG. 4, the ridge 143 on the substrate plate 141 has four recesses 145, which are disposed along the lengthwise direction of the substrate plate 141, i.e. the lengthwise direction of the supporting housing 101. Furthermore, the bottom side 109 of the supporting housing 101 has a width bigger than a width of the topside 107 of the supporting housing 101, so as to accommodate the ridge 143 in the cavity 115.

Figure 6:
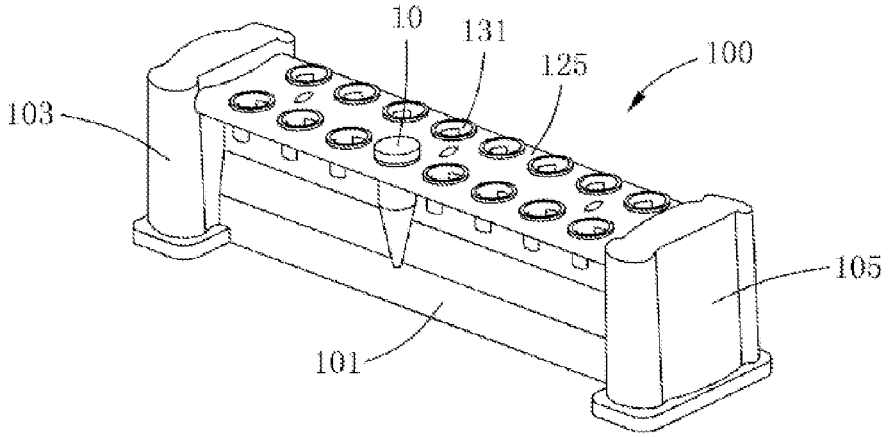
FIG. 6 shows a perspective view of the magnetic rack 100 shown in FIGS. 1-5 with a sample vial inserted therein.

FIG. 6 shows a perspective view of the magnetic rack 100 shown in FIGS. 1-5, wherein a sample vial 10 is inserted in the aperture 131 of the retaining plate 125. As shown in FIG. 6, the sample vial 10 has a cylindrical upper portion and a tapered lower portion. The tapered lower portion of the sample vial 10 can substantially approach the outer wall of the supporting housing 101 so as to get close to the magnets inside the supporting housing 101. In this way, the magnetic field can be applied onto the magnetic particles in the sample vial 10 through the supporting housing 101 to collect the particles on the wall or bottom of the sample vial 10.

Figure 7:
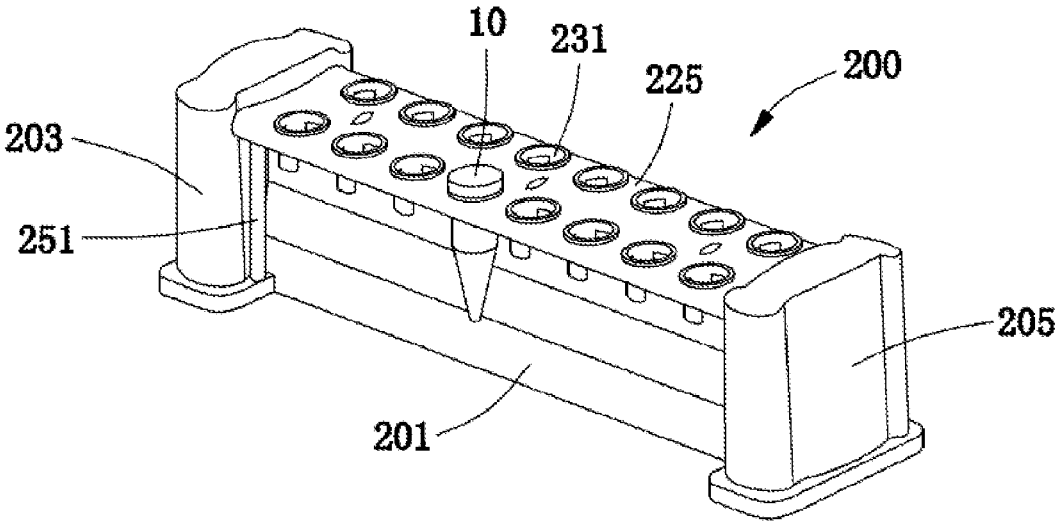
FIGS. 7-9 show a magnetic rack 200 according to another embodiment of the present application.
Figure 8:
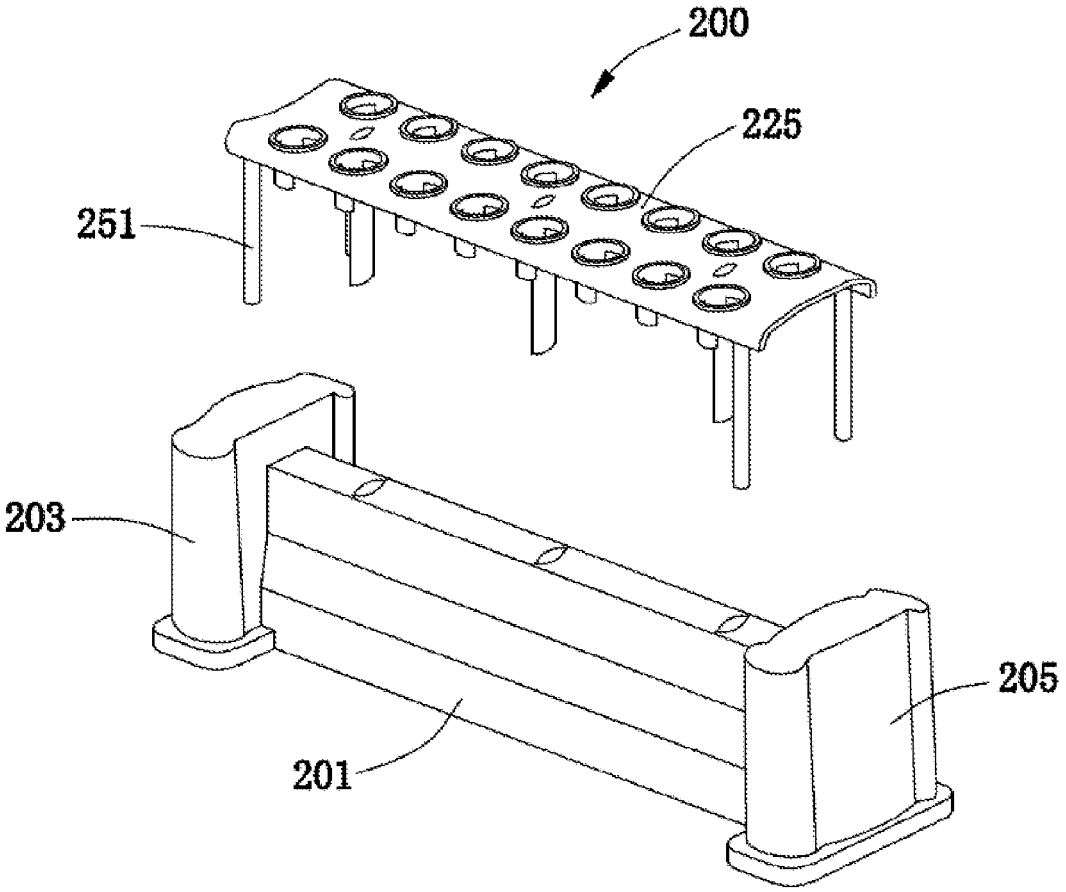
Figure 9:
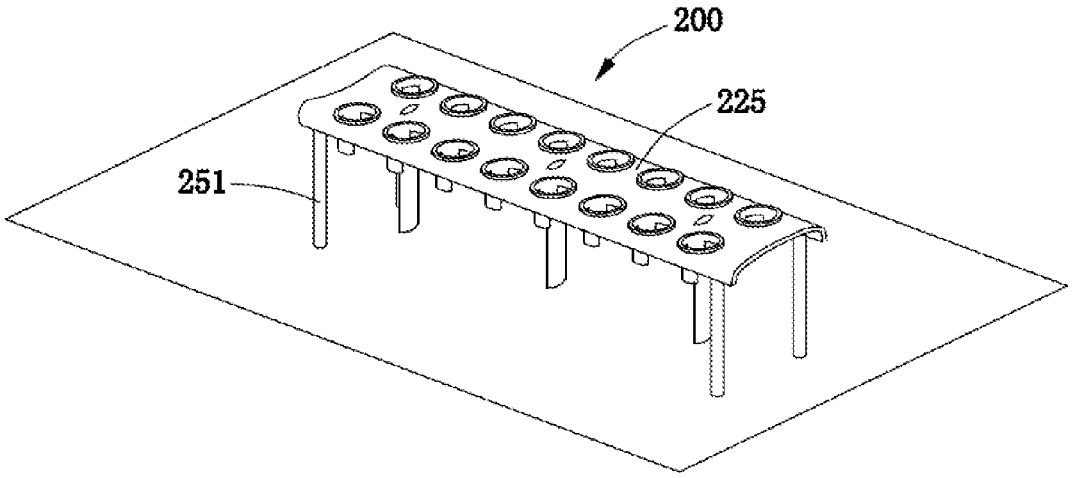

FIGS. 7-9 show a magnetic rack 200 according to another embodiment of the present application.

As shown in FIGS. 7-9, the magnetic rack 200 has a supporting housing 201, a pair of supporting wall 203 and 205, and a retaining plate 225 with a downward side and an upward side. The retaining plate 225 has at least one aperture 231 for holding a sample vial 10. The retaining plate 225 has at least one supporting members extruding from its downward side.

The magnetic rack 200 further has a stand 251 attached onto the retaining plate 225, for example, on the downward side of the retaining plate 225. In certain embodiments, the stand 251 may have multiple pillars secured on the backward side. For example, the stand 251 may include four pillars at four corners of the retaining plate 225. Alternatively, the stand 251 may include two plates extending in a lengthwise direction of the retaining plate 225. As shown in FIG. 9, with the stand 251, the retaining plate 225 can be supported on a supporting surface such as a table or a test bench when the retaining plate 225 is removed from the supporting housing 201, while sample vials (not shown) can still be stably and vertically carried on the retaining plate 225.

In certain embodiments, the stand 251 can be integrally formed with the retaining plate 225. For example, the stand 251 and the retaining plate 225 can be made of plastic materials using a molding process. Alternatively, the stand 201 may also be formed separately from the retaining plate 225, and attached onto the retaining plate 225 using adhesive or other suitable means.

While the present disclosure has been illustrated and described in detail in the drawings and foregoing description, such illustration and description are to be considered illustrative or exemplary and not restrictive; the present disclosure is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. Any reference signs in the claims should not be construed as limiting the scope. The scope and spirit of the present disclosure is defined by the appended claims.

What is claimed is:

1. A magnetic rack (100), comprising:

a supporting housing (101) having a top side (107), a bottom side (109) having a width bigger than that of the top side, two opposite lengthwise sides (111, 113), and a cavity (115), wherein at least one magnet (117) is disposed in the cavity, each lengthwise side is attached with a receiving member (119), and the top side has at least two sockets (135);

a pair of supporting walls (103, 105), wherein each supporting wall has a fixing member (121) introduced onto or into the receiving member to connect the supporting housing with the pair of supporting walls; wherein each supporting wall has a groove (123) at least partially extending between its to side and bottom side and with a width that enlarges from its top side to bottom side, and the lengthwise sides of the supporting housing are embedded into the respective grooves of the pair of supporting walls; and a retaining plate having a downward side (127), an upward side (129), at least one aperture (131) for holding a sample vial, and at least two supporting members (137) protruding from the downward side, wherein the at least two supporting members are slidable into the at least two sockets so that the retaining plate is removably supported on the top side of the supporting housing.

2. The magnetic rack of claim 1, further comprising:

a substrate plate (141) attachable to at least one of the bottom side of the supporting housing and the pair of supporting walls.

3. The magnetic rack of claim 2, wherein the substrate plate has a ridge (143) protruding towards the cavity and including at least one recess (145) for accommodating the at least one magnet.

4. The magnetic rack of claim 1, further comprising:

a pair of supporting wall covers (139) disposed on the retaining plate, and configured to clamp the retaining plate with the pair of supporting walls therebetween.

5. The magnetic rack of claim 1, wherein the receiving member comprises a side socket extending between the top side and the bottom side of the supporting housing, and the fixing member comprises a side plug parallel with the side socket and insertable into the side socket.

6. The magnetic rack of claim 1, wherein the at least one magnet is such configured that magnetic pellets in a sample vial retained in the magnetic rack are pulled down to the sidewall of the sample vial but above the bottom of the sample vial.

7. The magnetic rack of claim 6, wherein the magnetic pellets pulled down by the magnetic force are of a dimension smaller than 12 mm.

8. The magnetic rack of claim 1, further comprising:

a stand (251) attached onto the retaining plate and configured to support the retaining plate on a supporting surface when the retaining plate is removed from the supporting house.

9. The magnetic rack of claim 8, wherein the stand comprises multiple pillars secured on the downward side of the retaining plate and with a length greater than that of the at least two supporting members.

10. The magnetic rack of claim 9, wherein the multiple pillars are positioned at four corners of the retaining plate.

11. The magnetic rack of claim 8, wherein the stand is integrally formed with the retaining plate.

* * * * *